US008387496B2

(12) United States Patent
Schaede

(10) Patent No.: US 8,387,496 B2
(45) Date of Patent: Mar. 5, 2013

(54) METHOD AND SYSTEM FOR PRODUCING NOTES OF SECURITIES

(75) Inventor: Johannes Georg Schaede, Würzburg (DE)

(73) Assignee: KBA-Notasys SA, Luasanne (CH)

( * ) Notice: Subject to any disclaimer, the term of this patent is extended or adjusted under 35 U.S.C. 154(b) by 603 days.

(21) Appl. No.: 12/593,706

(22) PCT Filed: Apr. 7, 2008

(86) PCT No.: PCT/IB2008/051316

§ 371 (c)(1),
(2), (4) Date: Jan. 18, 2010

(87) PCT Pub. No.: WO2008/126005

PCT Pub. Date: Oct. 23, 2008

(65) Prior Publication Data

US 2010/0139463 A1 Jun. 10, 2010

(30) Foreign Application Priority Data

Apr. 13, 2007 (EP) ..... 07106185

(51) Int. Cl.
*B26D 7/27* (2006.01)

(52) U.S. Cl. ..... 83/27; 83/13; 83/112

(58) Field of Classification Search ..... 83/84, 94, 83/112, 27, 29, 39; 270/58.33, 58.34
See application file for complete search history.

(56) References Cited

U.S. PATENT DOCUMENTS 1,782,323 A * 11/1930 Spiess ..... 493/353
2,230,655 A * 2/1941 Sauerwein ..... 270/20.1
3,412,993 A 11/1968 Gori
3,939,621 A * 2/1976 Giori ..... 53/435
4,045,944 A 9/1977 Giori
4,299,325 A 11/1981 Quinton et al.
4,453,707 A 6/1984 Kuhfuss
4,558,557 A * 12/1985 Kuehfuss ..... 53/506
4,677,910 A 7/1987 Kuhfuss
4,793,251 A 12/1988 Kuhfuss
4,915,371 A 4/1990 Quinton
RE34,368 E * 9/1993 Frain ..... 101/483

(Continued)

FOREIGN PATENT DOCUMENTS

EP 0 167 196 A1 1/1986
EP 0 248 307 A1 12/1987

(Continued)

*Primary Examiner* — Sean Michalski
(74) *Attorney, Agent, or Firm* — Seager, Tufte & Wickhem LLC

(57) ABSTRACT

There is described a method and system for producing notes of securities, in particular banknotes, wherein individual printed sheets or successive printed portions of a continuous web are cut into individual notes on a sheet-fed or web-fed processing system, and wherein these individual notes are subsequently processed by a single-note processing system comprising a plurality of single-note processing stations. Individual notes corresponding to independent production cycles or dependent production cycles are produced on the sheet-fed or web-fed processing system, each production cycle being processed on a separate one of the single-note processing stations. Each production cycle is subdivided into a sequence of distinct production sub-cycles corresponding to successive subsets of individual notes (150) that are to be processed on the single-note processing stations, the subsets of individual notes being produced on the sheet-fed or web-fed processing system (300) according to a time-wise interleaved sequence of production sub-cycles corresponding to distinct production cycles.

27 Claims, 9 Drawing Sheets

U.S. PATENT DOCUMENTS

| | | | | |
|---|---|---|---|---|
| 5,414,974 | A * | 5/1995 | Van de Ven et al. | 53/399 |
| 5,426,921 | A * | 6/1995 | Beckmann | 53/566 |
| 5,489,091 | A * | 2/1996 | Greer et al. | 270/1.01 |
| 5,626,005 | A | 5/1997 | Klingelhoefer | |
| 5,660,106 | A | 8/1997 | Pitz et al. | |
| 7,096,784 | B2 | 8/2006 | Giori et al. | |
| 7,216,583 | B2 * | 5/2007 | Schaede | 101/76 |
| 7,273,008 | B2 | 9/2007 | Giori et al. | |
| 7,419,088 | B2 * | 9/2008 | Zhao et al. | 235/379 |
| 7,665,720 | B2 * | 2/2010 | Mori et al. | 270/52.16 |
| 7,975,906 | B2 * | 7/2011 | Schade et al. | 235/3 |
| 8,074,806 | B2 * | 12/2011 | Ozaki et al. | 209/534 |
| 2003/0131702 | A1 * | 7/2003 | Sauer et al. | 83/23 |
| 2004/0026851 | A1 | 2/2004 | Schaede et al. | |
| 2004/0232691 | A1 * | 11/2004 | Lazzerini | 283/67 |
| 2005/0060956 | A1 * | 3/2005 | Yui | 53/399 |
| 2005/0223922 | A1 | 10/2005 | Giori et al. | |
| 2006/0067559 | A1 * | 3/2006 | Donders | 382/100 |
| 2006/0162585 | A1 * | 7/2006 | Schaede | 101/76 |
| 2006/0208415 | A1 | 9/2006 | Lyu et al. | |
| 2006/0213384 | A1 | 9/2006 | Reinhard et al. | |
| 2006/0249040 | A1 | 11/2006 | Giori et al. | |
| 2007/0274567 | A1 | 11/2007 | Schaede | |
| 2008/0054544 | A1 * | 3/2008 | Calverley et al. | 270/58.02 |
| 2008/0250954 | A1 * | 10/2008 | Depta et al. | 101/170 |
| 2009/0003656 | A1 | 1/2009 | Reinhard et al. | |
| 2010/0236432 | A1 * | 9/2010 | Foresti et al. | 101/167 |
| 2011/0240734 | A1 * | 10/2011 | Sudo et al. | 235/379 |
| 2011/0315760 | A1 * | 12/2011 | Ito et al. | 235/375 |
| 2012/0011813 | A1 * | 1/2012 | Nakai et al. | 53/447 |
| 2012/0041590 | A1 * | 2/2012 | Ozaki et al. | 700/214 |

FOREIGN PATENT DOCUMENTS

| | | | |
|---|---|---|---|
| EP | 0 598 679 | A1 | 5/1994 |
| EP | 0 598 679 | B2 | 5/1994 |
| EP | 0 656 309 | A1 | 6/1995 |
| EP | 0 718 112 | A1 | 6/1996 |
| EP | 1 607 355 | A1 | 12/2005 |
| WO | 01/49464 | A1 | 7/2001 |
| WO | 01/85457 | A1 | 11/2001 |
| WO | 01/85586 | A1 | 11/2001 |
| WO | 2004/016433 | A1 | 2/2004 |
| WO | 2005/008605 | A1 | 1/2005 |
| WO | 2005/008606 | A1 | 1/2005 |
| WO | 2007/148288 | A2 | 12/2007 |

* cited by examiner

METHOD AND SYSTEM FOR PRODUCING NOTES OF SECURITIES

TECHNICAL FIELD

The present invention generally relates to a method and system for producing notes of securities, in particular banknotes, wherein individual printed sheets or successive printed portions of a continuous web are cut into individual notes on a sheet-fed or web-fed processing system, and wherein these individual notes are subsequently processed by a single-note processing system comprising a plurality of single-note processing stations.

BACKGROUND OF THE INVENTION

Banknotes and the like securities are commonly produced in the form of individual sheets or successive portions of a continuous web each carrying a plurality of individual security prints arranged in a matrix of columns and rows, which sheets or web portions are subjected to various printing and processing steps before being cut into individual notes. Among the printing and processing steps typically carried out during the production of banknotes are offset printing, intaglio printing, silk-screen printing, foil application, letterpress printing and/or varnishing. Other processing steps might be carried out during the production such as window cutting, ink-jet marking, laser marking, micro-perforation, etc. Once fully printed, the sheets or successive portions of continuous web have to be subjected to a so-called finishing process wherein the sheets or successive portions of continuous web are processed, i.e. cut and assembled, to form note bundles and packs of note bundles.

Banknotes and the like securities further have to meet strict quality requirements, especially concerning the printing quality thereof. Therefore, during the course of their production, banknotes or securities are typically inspected in order to detect, and advantageously mark, defective notes, i.e. notes exhibiting a low printing quality, printing errors, physical damages and the like, such that these defective notes can be sorted out. Inspection can be carried out at various stages of the production, manually, on-line on the printing or processing presses, and/or off-line on dedicated inspection machines. Final inspection of the banknotes can be carried out prior to finishing and/or after finishing as this will be explained hereinafter in reference to FIGS. 1 and 2A, 2B which are illustrative of the prior art.

FIG. 1 summarizes a typical process of producing securities wherein a final inspection step is carried out prior to finishing. The production process illustrated in FIG. 1 is advantageous in that it enables maximisation of the production efficiency by reducing waste to a minimum and enables the productions of note bundles and packs of note bundles with uninterrupted numbering sequence.

Step S1 in FIG. 1 denotes the various printing phases which are typically carried out during the production of securities. As mentioned, these various printing phases include in particular an offset printing phase whereby sheets of securities are printed on one or both sides with an offset background, an intaglio printing phase whereby the sheets are printed on one or both sides with intaglio features (i.e. embossed features which are readily recognizable by touch), a silk-screen printing phase whereby the sheets are printed on one or both sides with silk-screen features, such as features made of optically variable ink (OVI), and/or a foil/patch application phase whereby foils or patches, in particular so-called optically variable devices (OVD), holograms, or similar optically diffractive structures, are applied onto one or both sides of the sheets, etc.

As a result of the various printing phases of step S1, successive sheets 100 are produced. While quality control checks are usually performed at various stages during the production of the securities, a final quality check is typically carried out on the full sheets after these have completely been printed. This full-sheet quality inspection is schematised by step S2 in FIG. 1. Three categories of sheets in terms of quality requirements are generated as a result of this full-sheet quality inspection, namely (i) good sheets (i.e. sheets carrying securities which are all regarded to be satisfactory from the point of view of the quality requirements), (ii) partly defective sheets (i.e. sheets carrying both securities which are satisfactory from the point of view of the quality requirements and securities which are unacceptable, which defective securities are typically provided with a distinct cancellation mark), and (iii) entirely defective sheets carrying no acceptable security. From this point onward, the three categories of sheets follow distinct routes. More precisely, the entirely defective sheets are destroyed at step S10, while the good sheets are processed at steps S3 to S5 and the partly defective sheets are processed at steps S20 to S23.

Referring to steps S3 to S5, the good sheets are typically numbered at step S3, then optionally varnished at step S4, and finally cut and subjected to an ultimate finishing process at step S5, i.e. stacks of sheets 100 are cut into individual bundles of securities 200, which bundles 200 are typically banderoled (i.e. surrounded with a securing band) and then stacked to form packs of bundles 210. While the sheets 100 are processed in succession at steps S3 and S4, step S5 is usually carried out on stacks of hundred sheets each, thereby producing successive note bundles 200 of hundred securities each, which note bundles 200 are stacked to form, e.g., packs 210 of ten note bundles each.

Referring to steps S20 to S23, the partly defective sheets are firstly cut into individual securities at step S20 and the resulting securities are then sorted out at step S21 (based on the presence or absence of the cancellation mark previously applied at step S2 on the defective securities), the defective securities being destroyed at step S10, while the good securities are further processed at steps S22 and S23. At step S22, the individual securities are numbered in succession and subsequently subjected to a finishing process at step S23 which is similar to that carried out at step S5, i.e. note bundles of securities 200 are formed, which note bundles 200 are banderoled and then stacked to form packs of note bundles 210.

While FIG. 1 is discussed in the context of the production of securities on individual sheets, it shall be understood that the same principle is applicable to the production of securities on a continuous web. In that context, steps S1, S2, S3 and S4 could each be carried by processing a continuous web of printed material, which continuous web is ultimately cut into individual securities.

As regards the varnishing operation, FIG. 1 shows that such varnishing is typically carried out on full sheets at step S4 after full-sheet numbering at step S3. While this varnishing step is preferred, it is not as such required. Varnishing may furthermore be carried out at a different stage of the production, for example before (or immediately after on the good and partly defective sheets) full-sheet inspection at step S2 (which other solution would imply that numbering is carried out after varnishing).

In case keeping the numbering sequence throughout the securities of successive bundles 200 is not required, the partly defective sheets could follow a somewhat similar route as the good sheets, i.e. be subjected to a full-sheet numbering step (thereby numbering both the good and defective securities), then to full-sheet varnishing, before being cut into individual securities, sorted out to extract and destroy the defective securities, and then subjected to an ultimate finishing process to form bundles and packs of bundles (in this case single-note numbering would not be required). Such an alternate production process is illustrated in FIG. 2A.

Step S1* in FIG. 2A is similar to step S1 of FIG. 1, i.e. successive sheets 100 are produced, i.e. subjected successively to offset printing, intaglio printing, silk-screen printing, foil/patch application, etc. Step S2* in FIG. 2A is similar to step S3 of FIG. 1, i.e. full sheets are numbered in an appropriate numbering press. In this case however, one shall understand that both good and defective sheets are numbered. The numbered sheets are then optionally varnished at step S3*, before being cut into individual notes at step S4*.

At step S5*, single-note inspection is carried out, i.e. each individual note is inspected from the point of view of quality, and defective notes are sorted out in the process, which defective notes are destroyed at step S7*. The good notes, on the other hand, are then subjected to an ultimate finishing operation at step S6*, i.e. individual note bundles 200 are formed, which note bundles 200 are stacked to form packs 210 of note bundles 200, e.g. packs of ten bundles.

According to a variant of the production process of FIG. 2A, numbering could be carried out in a single-note numbering process before or after the single-note inspection and sorting at step S5*. Such variant is illustrated in FIG. 2B. Steps S1, 52**, 53**, 54**, S6** and S7** respectively correspond to steps S1*, S3*, S4*, S5*. S6* and S7* of FIG. 2A and do not need to be explained again. In the variant of FIG. 2B, as compared to the process of FIG. 2A, full-sheet numbering is replaced by a single-note numbering process (step S5**) following the single-note inspection and sorting at step S4**. In other words, the good notes sorted out after step S4** are numbered, preferably in a consecutive manner before being bundled and packed at step S6****.

For the sake of completeness, one may refer to International applications Nos. WO 01/85457 A1, WO 01/85586 A1, WO 2005/008605 A1, WO2005/008606 A1, and WO 2005/104045 A2 for an overview of possible full-sheet quality inspection machines to carry out step S2 in FIG. 1. Of particular interest are the machines disclosed in International applications WO 01/85457 A1, WO 01/85586 A1, WO 2005/008605 A1 and WO 2005/008606 A1 which combine the functions of full-sheet quality inspection and full-sheet numbering (which machines can thus perform the operations of steps S2 and S3 in one pass). A full-sheet inspection machine is sold by the Applicant under the trade name Nota Check®, while a combined full-sheet inspection and numbering machine is sold by the Applicant under the trade name Super Check Numerota®.

The interested reader may furthermore refer to US patent Nos. U.S. Pat. Nos. 3,939,621, 4,045,944, 4,453,707, 4,558,557, to European patent applications Nos. EP 0 656 309, EP 1 607 355, and to International application No. WO 01/49464 A1, all in the name of the present Applicant, for a discussion of various cutting and finishing machines suitable for carrying out step S5 of FIG. 1. Such machines are for instance sold by the Applicant under the trade name CutPak®. Those machines are easily adaptable to perform only cutting of sheets into individual notes at step S20 of FIG. 1, step S4* of FIG. 2A, or step S3 of FIG. 2**B.

As regards the more specific issue of full-sheet numbering, European patent application No. EP 0 598 679 A1 and International application No. WO 2004/016433 A1 are of interest. The numbering and finishing principle discussed in WO 2004/016433 A1 is of particular interest in this context as it provides for the numbering of sheets in a manner such that bundles of securities are produced in a consecutive and uninterrupted numbering sequence at the end of the finishing process without this requiring any complex bundle collating system. Numbering machines for carrying out full-sheet numbering are for instance sold by the Applicant under the trade name SuperNumerota®, as well as under the above-mentioned Super Check Numerota® trade name.

In the context of single-note sorting and numbering as provided under steps S21 and S22 of FIG. 1, one may refer to US patents Nos. U.S. Pat. Nos. 3,412,993, 4,299,325, 4,915,371. A machine combining the functions of single-note sorting and numbering (and optionally bundling and packing) is for instance sold by the Applicant under the trade name NotaNumber®. Such machine could for instance be used to carry out single-note sorting, numbering and finishing in the processes of FIG. 1 (steps S21 to S23) and FIG. 2B (steps S4 to 56****).

Single-note inspection and sorting systems for carrying out step S5* in the process of FIG. 2A and step S4 in the process of FIG. 2**B are also known as such in the art.

A disadvantage of the production principle illustrated in FIG. 2A resides in the fact that it does not readily allow the production of consecutively-numbered securities as the numbering is carried out before single-note inspection and sorting.

As regards both production principles illustrated in FIGS. 2A and 2B, several single-note processing stations have to be installed in parallel in order to reach a comparable production efficiency as that of the production principle illustrated in FIG. 1, as this will be explained below.

A conventional production rate of a sheet-fed production line is of the order of 10'000 to 12'000 sheets per hour. The same applies to web-fed production lines. Depending on the sheet layout, such production rate typically corresponds to a note output of between 400'000 to 720'000 notes per hour (it being understood that each sheet typically carries between 40 to 60 notes). Single-note processing systems are limited by the natural laws of physics to a speed of approximately 120'000 notes per hour.

In the context of the production principle of FIG. 1, the above-mentioned limitations are not critical as a single-note processing system is only used at steps S21 and S22 to process partly defective sheets, which partly-defective sheets amount to only a small portion (e.g. <10%) of the production volume. In contrast, in the context of the production principles of FIGS. 2A and 2B, the whole production volume is processed at step S5* and S6*, respectively S4 to S6**, on a single-note processing system. In other words, in order to cope with the higher production rate of the sheet-fed production line, usually four or five single-note processing stations are used in practice to process the whole production volume in parallel. This will now be explained in reference to FIG. 3 which is also illustrative of the art and shows a possible implementation for carrying out the production principle of FIG. 2**A.

In FIG. 3, reference 300 denotes a sheet-fed production line (or sheet-fed processing system), in this example with seven successive sheet-fed printing or processing stations 301 to 307, e.g. an offset printing press 301, a silk-screen printing press 302, a foil application machine 303, an intaglio printing press 304, a numbering press 305, an optional varnishing machine 306 and a cutting machine 307. Stations 301 to 304 perform full-sheet printing of unprinted sheets 100* according to step S1* of FIG. 2A, thereby yielding a set of printed sheets 100 which are numbered at station 305 and then varnished at station 306 before being cut into individual notes 150 at station 307 (i.e. the sheets are processed in succession according to steps S2*, S3* and S4* of FIG. 2A).

As illustrated in FIG. 3, the sheet-fed processing system 300 is coupled to a single-note processing system 400 comprising a plurality of single-note processing stations SNPS 1 to SNPS 4 (also designated by reference numerals 401 to 404) which are coupled to the output of the sheet-printing and processing line 300 to process the individual notes 150 in order to produce note bundles 200 and packs 210 of note bundles 200 (each station 401 to 404 performing at least steps S5* and S6* of FIG. 2).

Let us consider for the sake of explanation that, in the context of FIG. 3, each printed sheet bears fifty notes, which means that the production capacity of the sheet-fed production line would be of 500,000 notes per hour at a sheet-processing speed of 10'000 sheets per hour. In this case, and considering a single-note processing speed of 120'000 notes per hour, four single-note processing systems are required to best match the production speed of the sheet-fed processing system 300, such being the case in the illustration of FIG. 3.

It is typically desired to produce a certain volume of individual securities corresponding to a given numbering cycle. Let us for instance consider, for the sake of explanation, that the given numbering cycle corresponds to a set of one million notes numbered with serial numbers ranging from x'0'000'001 to x'1'000'000 ("x" representing one or more prefixes). In the context of the production principle illustrated in FIGS. 2 and 3, this fixed volume is usually subdivided into as many groups as there are single-note processing stations (i.e. four groups of 250'000 notes each in this example), which groups are processed in succession by the SNPS 1 to SNPS 4. In other words, the sheet-fed or web-fed processing system 300 outputs a continuous flow of notes that are fed in succession to the single-note processing system 400, the first group of 250'000 notes (i.e. notes x'0'000'001 to x'0'250'000) being processed b station 401, the second group (i.e. notes x'0'250'001 to x'0'500'000) by station 402, and so on until the fourth and last group of 250'000 notes (i.e. notes x,0'750'001 to x'1'000'000) which is processed by station 404.

In order to implement the production principle of FIG. 2B, a similar production facility as that illustrated in FIG. 3 could be used. The only difference would reside in the fact that the numbering press 305 would be discarded and that each single-note processing station SNPS 1 to SNPS 4 would be provided with its own numbering capability to carry out the single-note numbering process of step S5 of FIG. 2**B.

A problem with the known approach discussed above resides in the fact that, when one single-note processing station experiences a hiccup (such as a machine failure) and needs to be stopped, the continuous flow of notes from the sheet-fed or web-fed processing system 300 must be interrupted. The whole production cycle is accordingly affected and can only be resumed once the hiccup is resolved.

An improved solution for performing the production principle of FIG. 2A or 2B is thus required.

SUMMARY OF THE INVENTION

An aim of the invention is to provide such an improved solution.

In particular, an aim of the present invention is to provide a method and system for producing securities that overcome the limitations of the known methods and that are less affected by a hiccup of a single-note processing station.

These aims are achieved thanks to the method and system defined in the claims.

According to the present invention, individual notes corresponding to independent production cycles or dependent production cycles are produced on a sheet-fed or web-fed processing system, each production cycle being subsequently processed on a separate one of a plurality of single-note processing stations. Each production cycle is subdivided into a sequence of distinct production sub-cycles corresponding to successive subsets of individual notes that are to be processed on the single-note processing stations, these subsets of individual notes being produced on the sheet-fed or web-fed processing system according to a time-wise interleaved sequence of production sub-cycles corresponding to distinct production cycles.

As a result, as this will be explained hereinafter in greater detail, a hiccup of one single-note processing station, such as a machine failure, does not affect and cause an interruption of the whole production process, as in the case of the prior art approach. Rather, the hiccup only temporarily affects the processing by the single-note processing station where the hiccup occurs.

According to a preferred implementation, the subsets of individual notes are buffered in succession at an input of the corresponding single-note processing station, thereby ensuring a continuous processing of the notes by the single-note processing stations.

Still according to a preferred implementation, the number of individual notes per subset is chosen to be a number comprised between 10'000 to 50'000 notes.

According to an advantageous embodiment, an automated guided vehicle system is used to transport the subsets of notes to and from the single-note processing stations.

Further embodiments form the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 3:
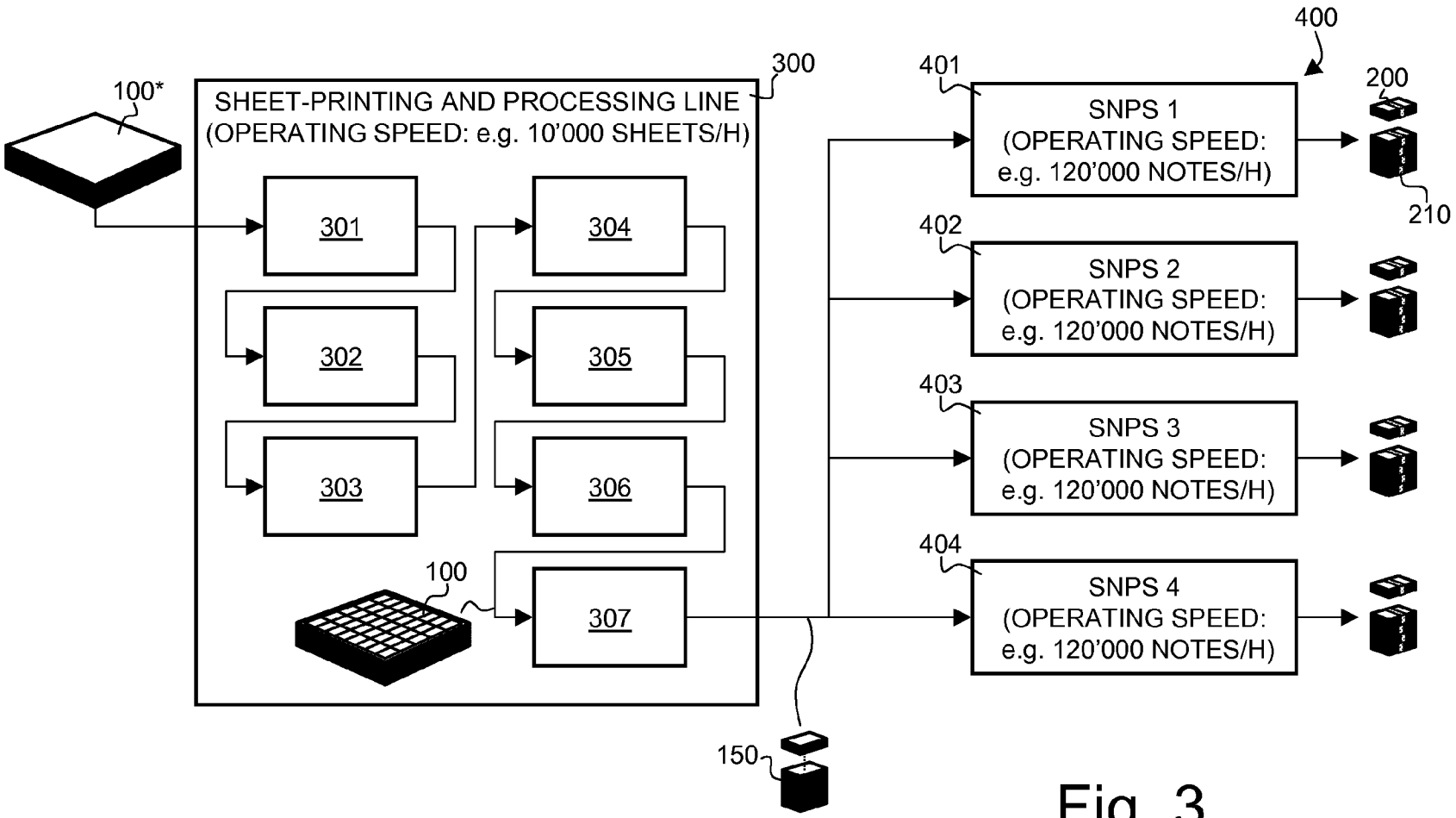
FIG. 3 is a schematic illustration of a production facility according to a known implementation of the production process of FIG. 2A.
Figure 4:
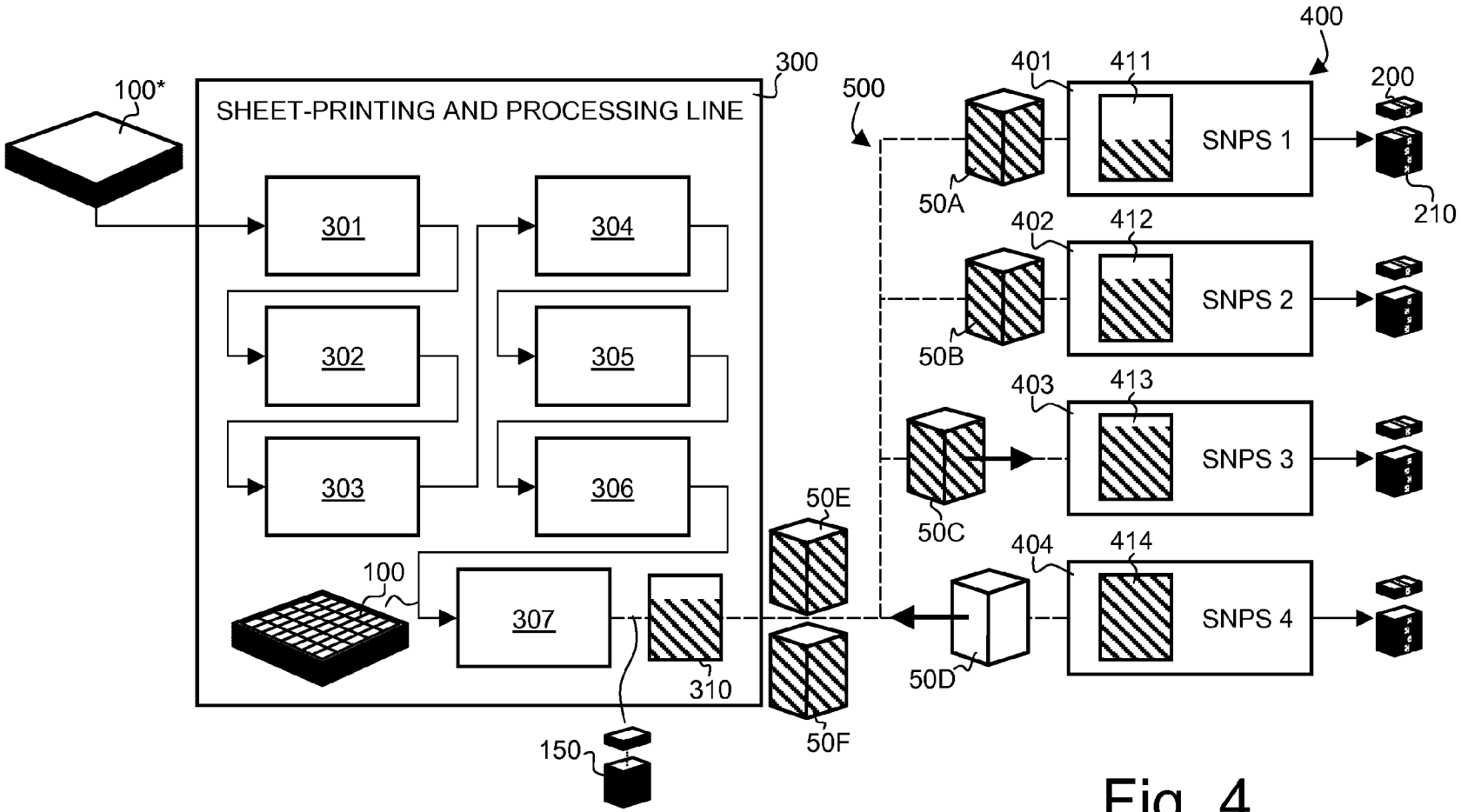
FIG. 4 is a schematic illustration of a production facility according to an implementation of the present invention for carrying out the production process of FIG. 2A.

FIG. 4 is a schematic illustration of a production facility according to an implementation of the present invention. In FIG. 4, there is shown a sheet-fed production line (or sheet-fed processing system) 300 similar to that illustrated in FIG. 3 comprising, in this example, seven successive sheet-fed printing or processing stations 301 to 307, e.g. an offset printing press 301, a silk-screen printing press 302, a foil application machine 303, an intaglio printing press 304, a numbering press 305, an optional varnishing machine 306 and a cutting machine 307. Stations 301 to 304 perform full-sheet printing of unprinted sheets 100* according to step S1 * of FIG. 2A, thereby yielding a set of printed sheets 100 which are numbered at station 305 and then varnished at station 306 before being cut into individual notes 150 at station 307 (i.e. the sheets are processed according to steps S2*, S3* and S4* of FIG. 2A).

Figure 1:
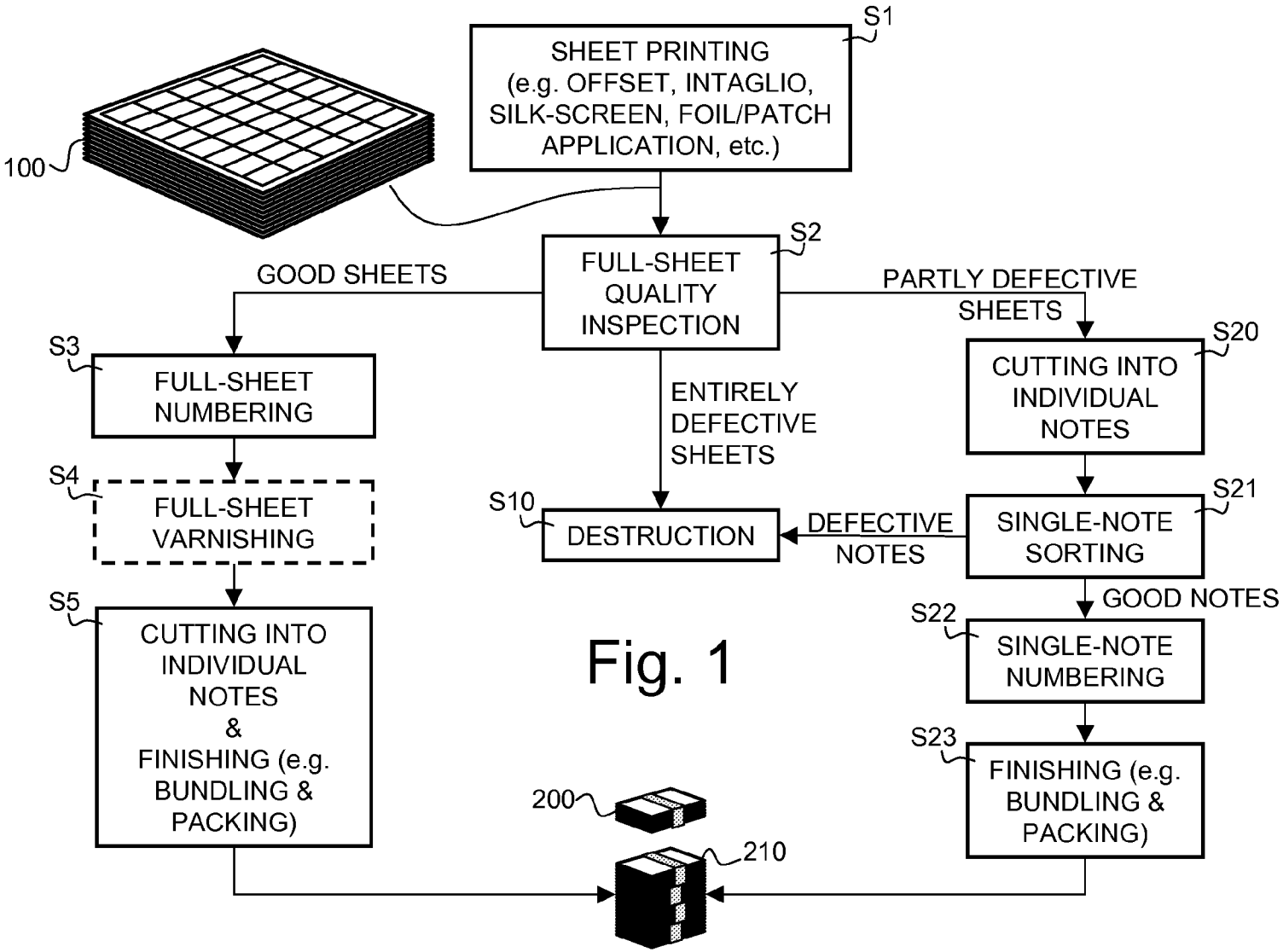
FIG. 1 is a flow chart illustrating a known process for producing notes of securities wherein only a small part of the production is subjected to single-note processing.
Figure 2A:
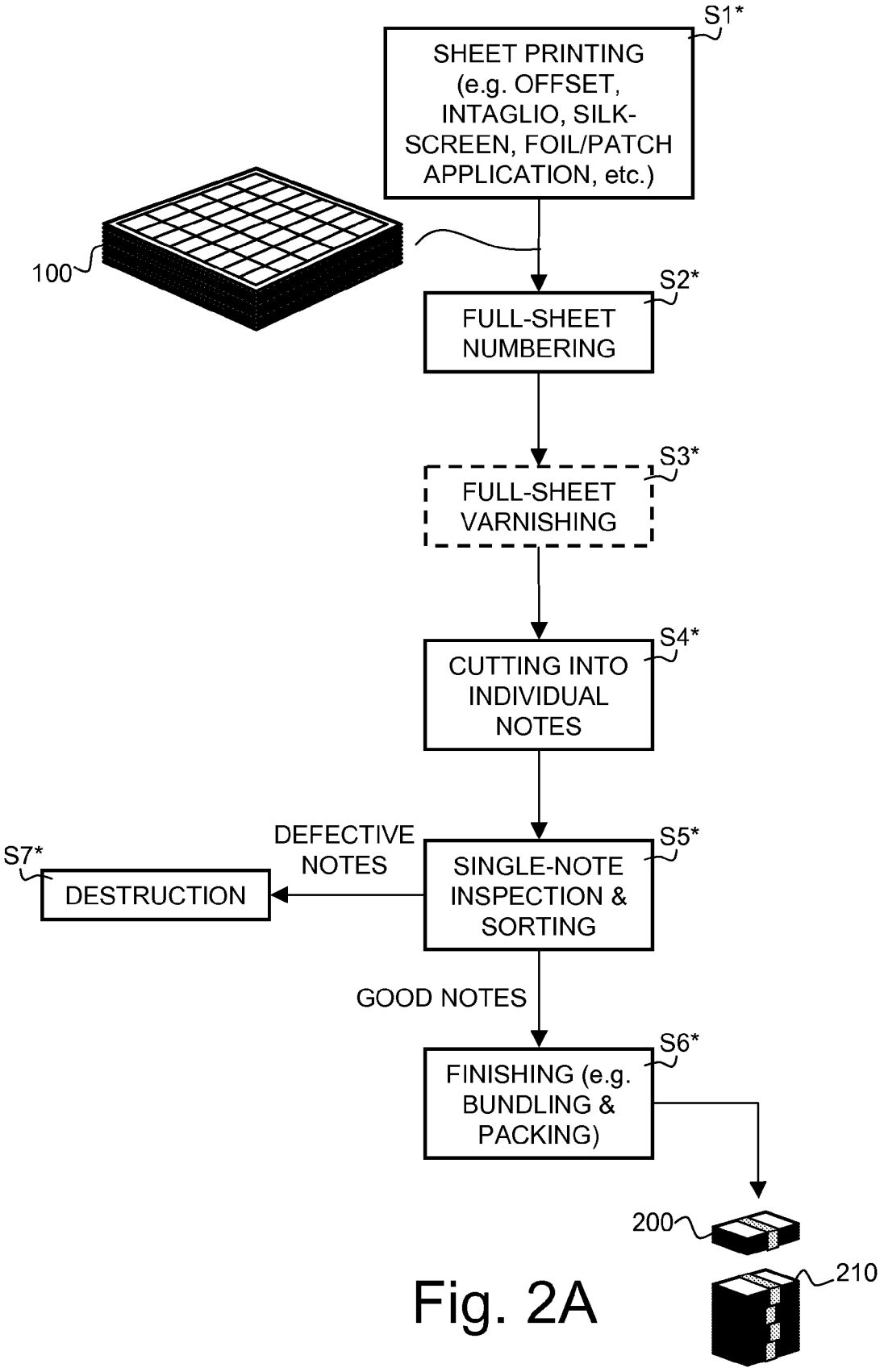
FIG. 2A is a flow chart illustrating a known alternative process for producing notes of securities wherein all the production is subjected to single-note processing.

The individual notes 150 produced by the sheet-fed processing system 300 of FIG. 4 are then processed, as in the case of FIG. 3, onto a single-note processing system 400 comprising a plurality of single-note processing stations SNPS 1 to SNPS 4 (also designated by reference numerals 401 to 404) designed to process the individual notes 150 and produce note bundles 200 and packs 210 of note bundles 200 (each station 401 to 404 performing at least steps S5* and S6* of FIG. 2A).

According to the present invention, and in contrast to the prior art production methodology illustrated in FIG. 3, the individual notes 150 are produced and processed in a different manner such as to avoid that the whole production is affected by a hiccup of one or more of the single-note processing stations. More precisely, according to the invention, each single-note processing station is designed to process individual notes 150 corresponding to independent production cycles or dependent production cycles produced by the sheet-fed processing system 300. Within the scope of the present invention, a "production cycle" will be understood as referring to the production, on the sheet-fed (or web-fed) processing system 300, of a determined number of individual notes 150 that is meant to form a consecutive set of individual notes.

According to a preferred embodiment of the invention, a "production cycle" will be understood as referring more particularly to a determined set of consecutively-numbered notes, or "numbering cycle". In such a case, a "production cycle", or "numbering cycle" may for instance correspond to a set of e.g. one million notes numbered in a consecutive manner with serial number ranging from x'0'000'001 to x'1'000'000 ("x" again representing one or more prefixes).

In the following description, one will refer to two exemplary situations wherein:

(i) a plurality of independent production cycles, referred to by designation letters A, B, C, etc., are processed; or (ii) a single production cycle, referred to by designation letter A, is processed, which single production cycle is subdivided into a plurality of dependent production cycles A1, A2, A3, etc.

One will further assume for the sake of illustration that the notes are produced on sheets each carrying fifty notes using a sheet-fed processing system operating at a speed of 10'000 sheets per hour, which amounts to 500'000 notes per hour.

According to situation (i), each single-note processing station is designed to process the notes of a corresponding one of independent production cycles A, B, C, D, etc. According to situation (ii), each single-note processing station is designed to process the notes of a corresponding one of dependent production cycles A1, A2, A3, A4, etc. (which jointly form production cycle A).

According to the invention, the sheet-fed processing system 300 is accordingly designed to output successive subsets of individual notes 150, each subset being destined to be processed by a corresponding one of the single-note processing stations. More precisely, in situation (i) above, each production cycle A, B, C, D, etc. is subdivided into a plurality of distinct production sub-cycles A.i, B.i, C.i, D.i, etc. (i=1, 2, 3, 4, . . . ), whereas, in situation (ii) above, the dependent production cycles A1, A2, A3, A4, etc. are subdivided into a plurality of production sub-cycles A1.i, A2.i, A3.i, A4.i, etc. (i=1, 2, 3, 4, . . . ).

The number of notes per subset is preferably selected to be a number comprised between 10'000 to 50'000 notes. Considering note bundles of hundred notes each, this represents a volume comprised between 100 to 500 note bundles, which volume is particularly suitable in the context of the present invention. For the sake of illustration, considering a banknote size of the order of 13 cm×7.5 cm (i.e. approximately 100 $cm^2$ of surface area) and a usual note bundle height of the order of 1.5 cm, the corresponding volume would represent between 15'000 to 75'000 cubic centimeters (i.e. 15 to 75 liters). While a greater number of notes per subset is perfectly possible within the scope of the present invention, the resulting size of each subset should preferably be kept to a reasonable volume that can easily be transported from the sheet-fed or web-fed processing system 300 to the single-note processing system 400.

In FIG. 4, reference numerals 310 and 411 to 414 designate buffer stages. More precisely, an output buffer stage 310 is preferably provided at the output of the sheet-fed processing system 300, which output buffer stage 310 enables buffering of the production of notes corresponding to a given production sub-cycle. Similarly, each single-note processing station SNSP 1 to SNPS 4 is provided with an input buffer stage 411, 412, 413, 414 for buffering the notes at the input of each single-note processing station. As this will be appreciated hereinafter, these input buffers 411 to 414 ensure a continuous operation of the single-note processing stations SNPS 1 to SNPS 4 and enable accumulation of the subsets of individual notes 150 that are fed in succession to the single-note processing stations.

Preferably, each subset of notes produced during each successive production sub-cycle is temporarily stored in a corresponding container device. Such container devices are schematically illustrated in FIG. 4 and designated by reference numerals 50A to 50F. The container devices 50A, 50B, 50C, 50E, 5OF are shown with hatchings and symbolise container devices full of a corresponding subset of notes. Container device 50D, on the other hand, is shown without any hatching and symbolises an empty container device. In FIG. 4, container device 50C is furthermore shown as being transported towards single-note processing station SNPS 3, while empty container device 50D is shown as being transported back to the output of the sheet-fed processing system 300. Container devices 50E and 5OF are shown as being located at the output of the sheet-fed processing system 300, container device 50E, which for instance contains a subset of notes destined to single-note processing station SNPS 4, being ready to be transported towards single-note processing station SNPS 4, while container device 50F, which for instance contains a subset of notes destined to single-note processing station SNPS 1, is waiting for the container device 50A to be emptied at single-note processing station SNPS 1. Additional container devices might be provided if necessary, it being understood that each container device can be dedicated to a given single-note processing station or be attributed dynamically to any one of the single-note processing stations SNPS 1 to SNPS 4, depending on the subset of notes it contains and the corresponding single-note processing station it is intended to supply.

In the above embodiment making use of container devices, the container devices could serve as the buffer stages 411 to 414 of the single-note processing stations SNPS 1 to SNPS 4.

According to a particularly advantageous implementation, the subsets of notes 150 are transported between the sheet-fed processing system 300 and the single-note processing stations SNPS 1 to SNPS 4 by means of an automated guided vehicle (AGV) system, which is schematically illustrated in FIG. 4 by the dashed-lines indicated by reference numeral 500. AGV's are known as such in the art and do not need to be described here again. Care should simply be taken that the AGV is adapted to be coupled to the output of the sheet-fed processing system 300 and to the input of the single-note processing stations SNPS 1 to SNPS 4 for suitably transferring the subsets of notes 150.

One will now describe an exemplary production process corresponding to situation (i) mentioned hereinabove. In this context, one will consider that four independent production cycles A to D are processed and that each independent production cycle A to D corresponds to a set of one million consecutively-numbered notes, i.e. notes bearing serial numbers A'0'000'001 to A'1'000'000 for production cycle A, serial numbers B'0'000'001 to B'1'000'000 for production cycle B, serial numbers C'0'000'001 to C'1'000'000 for production cycle C, and serial numbers D'0'000'001 to D'1'000'000 for production cycle D. Each production cycle A to D is subdivided into subsets of e.g. fifty thousand notes that will be produced by the sheet-fed processing system 300 according to the following sequence:

TABLE 1

| Production iteration | Production cycle | Production sub-cycle and corresponding subset of notes | Processing SNPS |
|---|---|---|---|
| 1 | A | A.1: A'0'000'001-0'050'000 | SNPS 1 |
| 2 | B | B.1: B'0'000'001-0'050'000 | SNPS 2 |
| 3 | C | C.1: C'0'000'001-0'050'000 | SNPS 3 |
| 4 | D | D.1: D'0'000'001-0'050'000 | SNPS 4 |
| 5 | A | A.2: A'0'050'001-0'100'000 | SNPS 1 |
| 6 | B | B.2: B'0'050'001-0'100'000 | SNPS 2 |
| 7 | C | C.2: C'0'050'001-0'100'000 | SNPS 3 |
| 8 | D | D.2: D'0'050'001-0'100'000 | SNPS 4 |
| 9 | A | A.3: A'0'100'001-0'150'000 | SNPS 1 |
| 10 | B | B.3: B'0'100'001-0'150'000 | SNPS 2 |
| 11 | C | C.3: C'0'100'001-0'150'000 | SNPS 3 |
| 12 | D | D.3: D'0'100'001-0'150'000 | SNPS 4 |
| 13 | A | A.4: C'0'150'001-0'200'000 | SNPS 1 |
| ... | ... | ... | ... |

In the above example, one will understand that each single-note processing station SNPS 1 to SNPS 4 will process twenty successive subsets of fifty thousand notes. One will further appreciate that, on a single-note processing station operating at a speed of 120'000 notes per hour, it will take twenty-five minutes to process each subset of fifty thousand notes, while the sheet-fed processing system 300 will produce the same number of notes in six minutes. In other words, under normal operating conditions, each single-note processing station SNPS 1 to SNPS 4 receives a new subset of notes to process at an interval of twenty-four minutes.

It will furthermore be appreciated that, in case a full-sheet numbering operation is carried out, as discussed in reference to FIG. 2A, the corresponding numbering press 305 of FIG. 4 will preferably comprise so-called "intelligent" numbering devices that are capable of being switched from one numbering job to another. Such intelligent numbering devices are for instance disclosed in International application No. WO 2004/016433 A1 in the name of the present Applicant, or in European patent application No. EP 0 718 112 A1, which applications are both incorporated herein by reference. Another type of intelligent numbering device is further discussed in International application No. PCT/IB2007/052366 filed on Jun. 20, 2007 (published as WO 2007/148288) entitled "NUMBERING DEVICE FOR TYPOGRAPHIC NUMBERING", in the name of the present Applicant, which International application claims priority of European patent application No. 06115994.3 filed on Jun. 23, 2006 and is also incorporated herein by reference.

According to an alternate implementation, numbering may be carried out as a single-note processing step (as discussed in reference to FIG. 2B) in each of the single-note processing stations SNPS 1 to SNPS 4. In such a case, conventional numbering devices, such as sequentially-actuated mechanical numbering devices, might be used.

Figure 5:
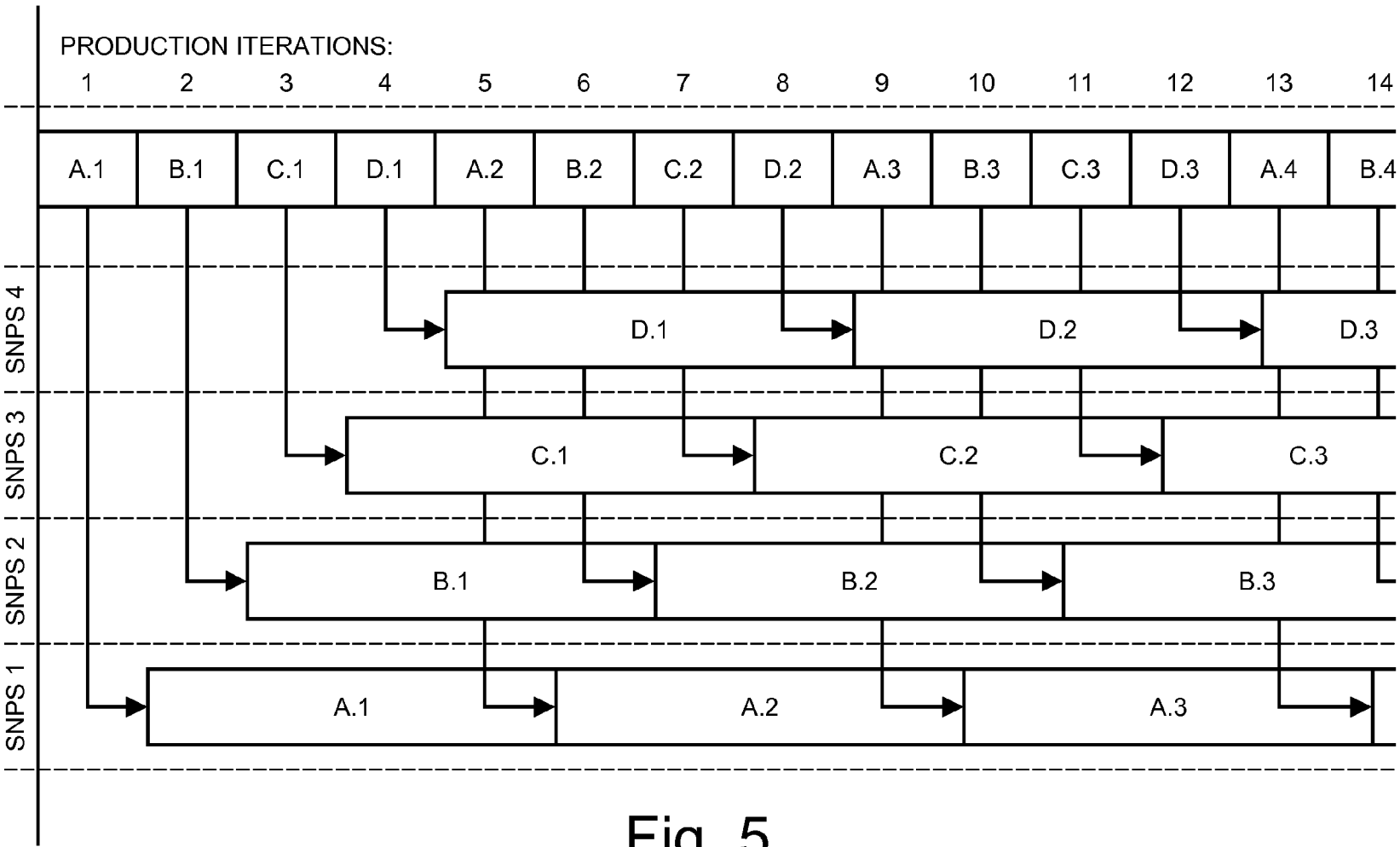
FIGS. 5 to 8 are diagrams illustrating exemplary situations showing how the notes of securities might be produced and processed using the production facility of FIG. 4.

The normal operating conditions summarized in Table 1 are schematically illustrated in the diagram of FIG. 5. The upper line in the diagram of FIG. 5 illustrates the sequence of subsets of notes produced by the sheet-fed processing system 300 of FIG. 4, i.e. subsets produced according to the following time-wise interleaved sequence (1) of production sub-cycles (as indicated in the third column of Table 1 above):

$$A.1>B.1>C.1>D.1>A.2>B.2>C.2>D.2>A.3>B.3>C.3> \quad (1)$$

The four remaining lines in the diagram of FIG. 5, which are designated by references "SNPS 1" to "SNPS 4" on the right-hand side of FIG. 5, schematically illustrate the processing of the above sequence of subsets of individual notes by the single-note processing stations SNPS 1 to SNPS 4, respectively. In operation, it will be appreciated that the single-note processing stations SNPS 1 to SNPS 4 operate simultaneously and in a time-wise staggered manner.

Let us now consider for the sake of illustration that single-note processing station SNPS 3 (reference 403 in FIG. 4) experiences a hiccup while processing the first subset C.1 of notes corresponding to production cycle C (production iteration 3 in Table 1). As a result of this hiccup, the time required for processing the first subset C.1 on single-note processing station SNPS 3 is inevitably increased.

Thanks to the production of a time-wise interleaved sequence of subsets of individual notes, as described hereinabove, which subsets are processed on the corresponding single-note processing stations, the whole production process is not halted as a result of the hiccup, as in the case of the prior art production facilities, but can continue, at least as far as the processing of the notes on the other single-note processing stations is concerned.

Figure 6:
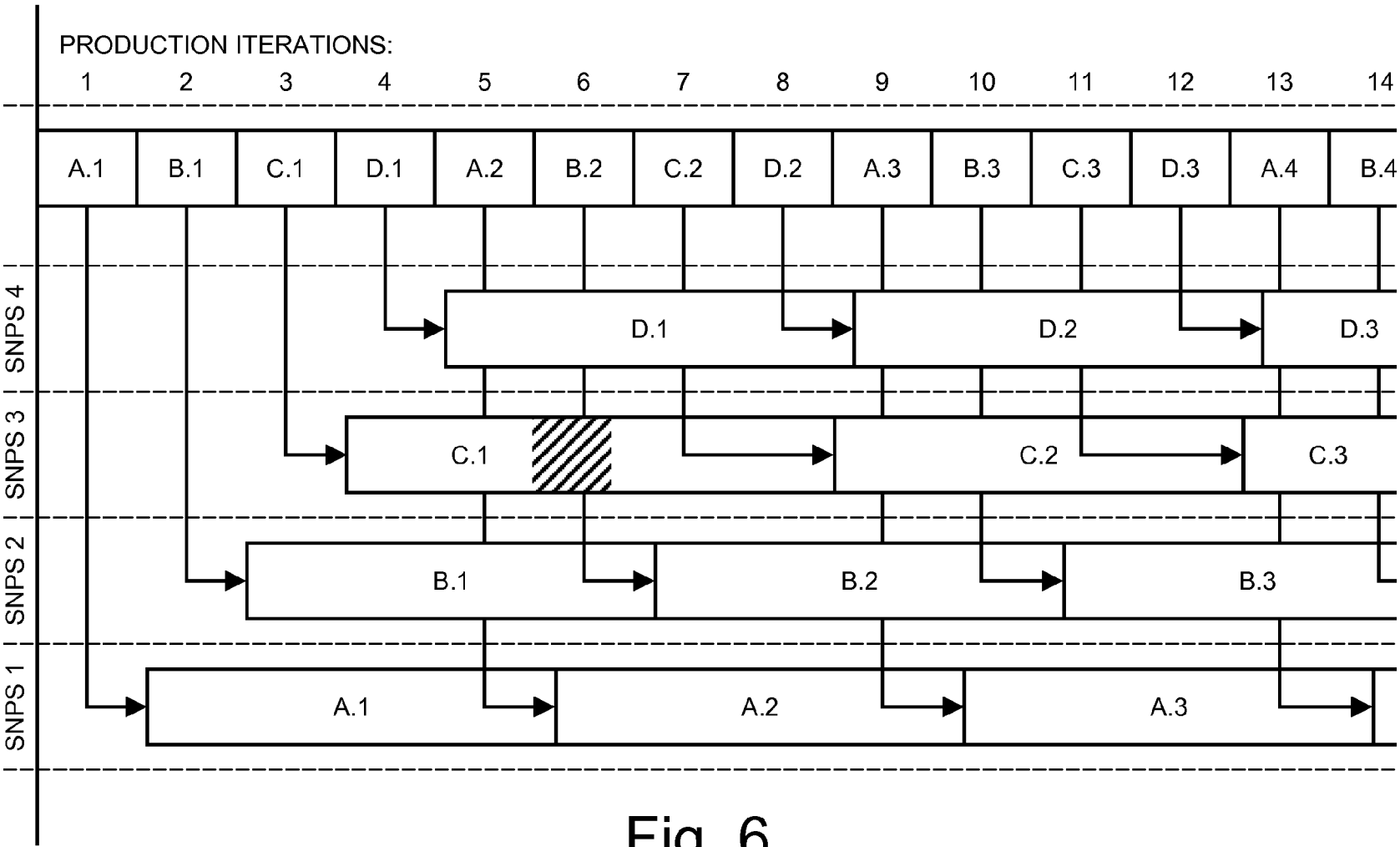

An exemplary situation wherein single-note processing station SNPS 3 experiences a problem during processing of its first production sub-cycle C.1 is schematically illustrated in the diagram of FIG. 6 which is substantially similar to that of FIG. 5. In FIG. 6, the hiccup of single-note processing station SNPS 3 is schematised by hatchings. As a result of the hiccup, only the processing of the notes on single-note processing station SNPS 3 is temporarily affected. The subset of individual notes produced by the sheet-fed processing system 300 during the subsequent production sub-cycle C.2 is simply buffered at the input of single-note processing station SNPS 3, as usual, and processing thereof can start as soon as the previous production sub-cycle C.1 has been completely processed. The processing of the notes on the other single-note processing stations SNPS 1, SNPS 2, and SNPS 4 remains unaffected.

Figure 7:
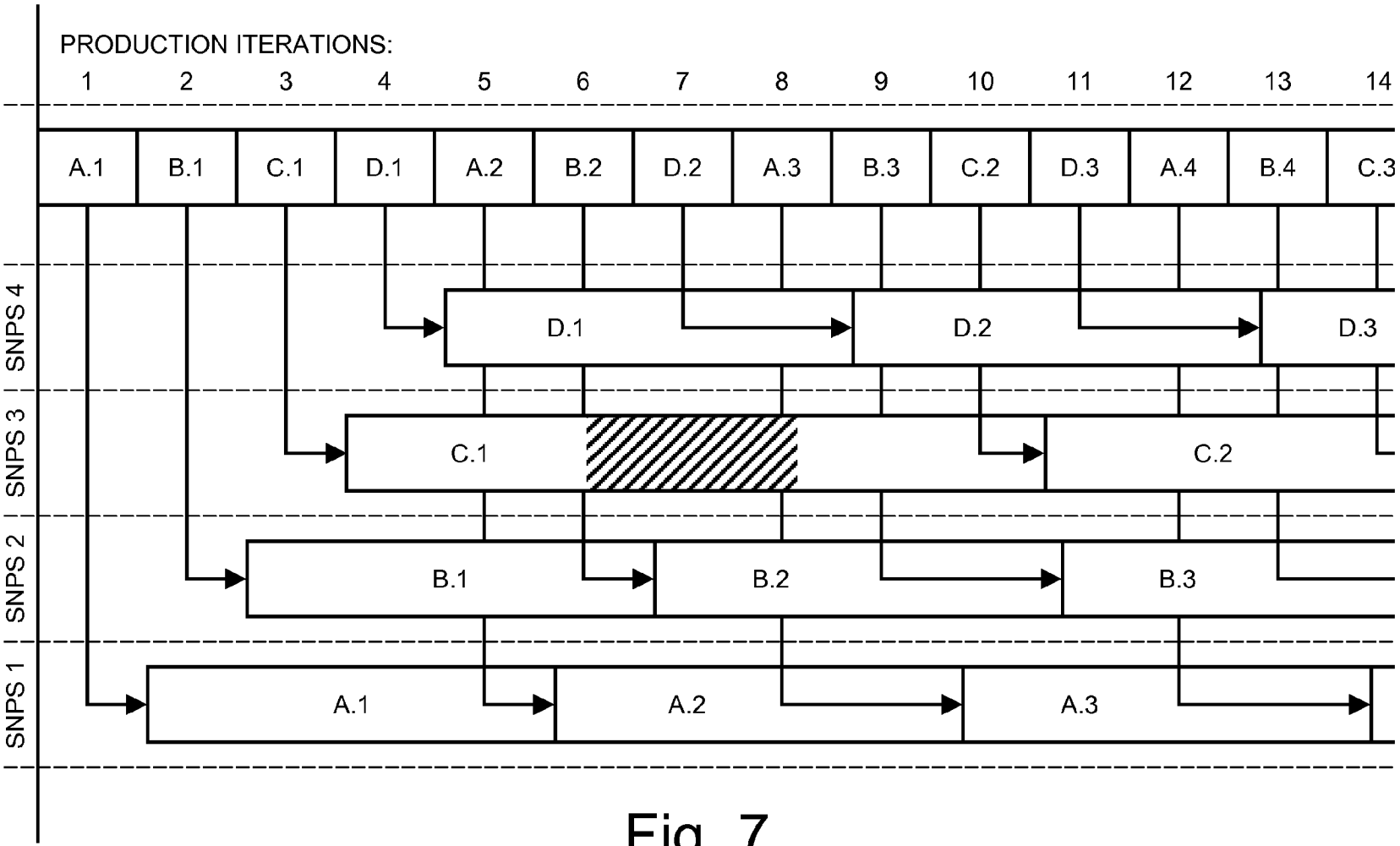

According to an alternate implementation, it might be possible to adapt the time-wise interleaved sequence of production sub-cycles carried out by the sheet-fed processing system 300 in dependence of an operating state of the single-note processing stations SNPS 1 to SNPS 4. Such an alternate implementation is schematically illustrated in the diagram of FIG. 7 which is substantially similar to those of FIGS. 5 and 6. In the diagram of FIG. 7, it is again assumed for the sake of illustration that single-note processing station SNPS 3 experiences a problem during processing of the subset of notes corresponding to its first production sub-cycle C.1. According to this alternate implementation, the time-wise interleaved sequence of production sub-cycles is modified by skipping the production of the subsequent production sub-cycle C.2 and delaying this production sub-cycle C.2 to a later stage. In this example, the subsets are for instance produced according to the following time-wise interleaved sequence (2) of production sub-cycles:

A.1>B.1>C.1>D.1>A.2>B.2>D.2>A.3>B.3>C.2>D.3> (2)

The corresponding production sequence of the sheet-fed processing system 300 is summarized in the following table:

TABLE 2

| Production iteration | Production cycle | Production sub-cycle and corresponding subset of notes | SNPS processing the subset |
|---|---|---|---|
| 1 | A | A.1: A'0'000'001-0'050'000 | SNPS 1 |
| 2 | B | B.1: B'0'000'001-0'050'000 | SNPS 2 |
| 3 | C | C.1: C'0'000'001-0'050'000 | SNPS 3 (hiccup) |
| 4 | D | D.1: D'0'000'001-0'050'000 | SNPS 4 |
| 5 | A | A.2: A'0'050'001-0'100'000 | SNPS 1 |
| 6 | B | B.2: B'0'050'001-0'100'000 | SNPS 2 |
| 7 | D | D.2: D'0'050'001-0'100'000 | SNPS 4 |
| 8 | A | A.3: A'0'100'001-0'150'000 | SNPS 1 |
| 9 | B | B.3: B'0'100'001-0'150'000 | SNPS 2 |
| 10 | C | C.2: C'0'050'001-0'100'000 | SNPS 3 |
| 11 | D | D.3: D'0'100'001-0'150'000 | SNPS 4 |
| 12 | A | A.4: A'0'150'001-0'200'000 | SNPS 1 |
| 13 | B | B.4: B'0'150'001-0'200'000 | SNPS 2 |
| ... | ... | ... | ... |

In the above alternate implementation, it is assumed that the hiccup of single-note processing station 403 can be solved in time for it to timely process the following subset C.2 of notes produced at production iteration 10. It will of course be appreciated that the production of the second subset C.2 of notes for production cycle C could be further delayed in case it takes more time to solve the hiccup issue of single-note processing station SNPS 3. The above example is of course purely illustrative.

Let us now turn to situation (ii) and consider that a production cycle A corresponding to a set of one million consecutively-numbered notes, i.e. notes bearing serial numbers A'0'000'001 to A'1'000'000. In this second situation, the single production cycle A is subdivided into a plurality, i.e. four, of dependent production cycles A1 to A4 each corresponding to a set of 250'000 consecutively-numbered notes, namely notes bearing serial numbers A'0'000'001 to A'0'250'000 for production cycle A1, serial numbers A'0'250,001 to A'0'500'000 for production cycle A2, serial numbers A'0'500'001 to A'0'750'000 for production cycle A3, and serial numbers A'0'750'001 to A'1'000'000 for production cycle A4. In a similar manner to the previous situation discussed hereinabove, each production cycle A1 to A4 is subdivided into successive subsets of e.g. fifty thousand notes that will be produced by the sheet-fed processing system 300 according to the following sequence:

TABLE 3

| Production iteration | Production cycle | Produced subset of notes | Processing SNPS |
|---|---|---|---|
| 1 | A1 | A1.1: A'0'000'001-0'050'000 | SNPS 1 |
| 2 | A2 | A2.1: A'0'250'001-0'300'000 | SNPS 2 |
| 3 | A3 | A3.1: A'0'500'001-0'550'000 | SNPS 3 |
| 4 | A4 | A4.1: A'0'750'001-0'800'000 | SNPS 4 |
| 5 | A1 | A1.2: A'0'050'001-0'100'000 | SNPS 1 |
| 6 | A2 | A2.2: A'0'300'001-0'350'000 | SNPS 2 |
| 7 | A3 | A3.2: A'0'550'001-0'600'000 | SNPS 3 |
| 8 | A4 | A4.2: A'0'800'001-0'850'000 | SNPS 4 |
| 9 | A1 | A1.3: A'0'100'001-0'150'000 | SNPS 1 |
| 10 | A2 | A2.3: A'0'350'001-0'400'000 | SNPS 2 |
| 11 | A3 | A3.3: A'0'600'001-0'650'000 | SNPS 3 |
| 12 | A4 | A4.3: A'0'850'001-0'900'000 | SNPS 4 |
| 13 | A1 | A1.4: A'0'150'001-0'200'000 | SNPS 1 |
| ... | ... | ... | ... |

In the above example, it will be understood that each single-note processing station SNPS 1 to SNPS 4 will process five successive subsets of fifty thousand notes.

Figure 8:
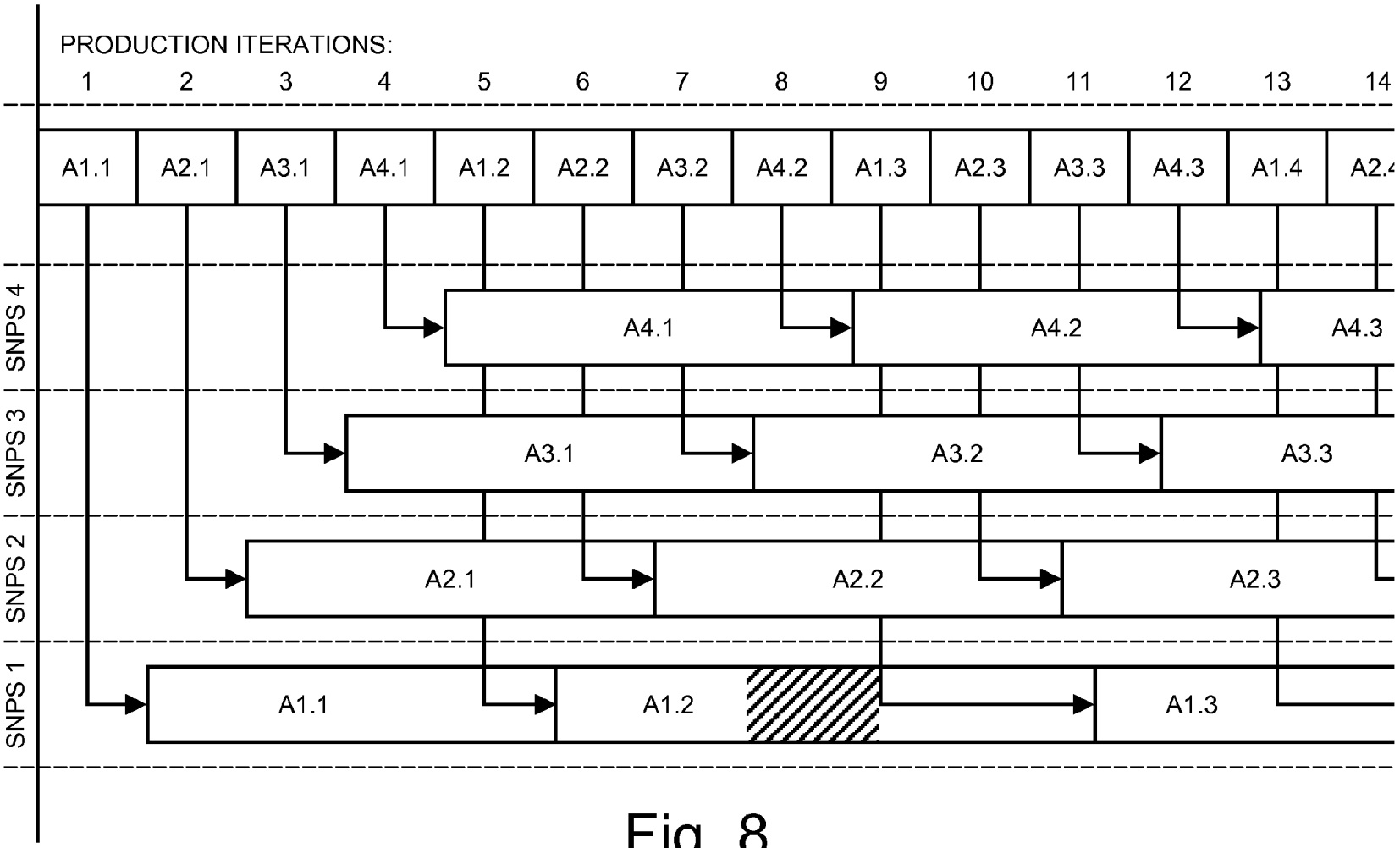

Let us consider for the sake of illustration that single-note processing station 401 experiences a hiccup while processing the second subset A1.2 of notes corresponding to production cycle A1 (production iteration 5 in Table 3). Such exemplary situation is schematically illustrated in the diagram of FIG. 8 which is substantially similar to those of FIGS. 5 to 7. In FIG. 8, the hiccup of single-note processing station SNPS 1 is again schematised by hatchings. As a result of the hiccup, only the processing of the notes on single-note processing station SNPS 1 is temporarily affected. The subset of individual notes produced by the sheet-fed processing system 300 during the subsequent production cycle A1.3 is simply buffered at the input of single-note processing station SNPS 1 and processing thereof can start as soon as the previous production sub-cycle A1.2 has been completely processed. The processing of the notes on the other single-note processing stations SNPS 2 to SNPS 4 remains unaffected.

It will be understood that various modifications and/or improvements obvious to the person skilled in the art can be made to the embodiments described hereinabove without departing from the scope of the invention defined by the annexed claims.

Figure 2B:
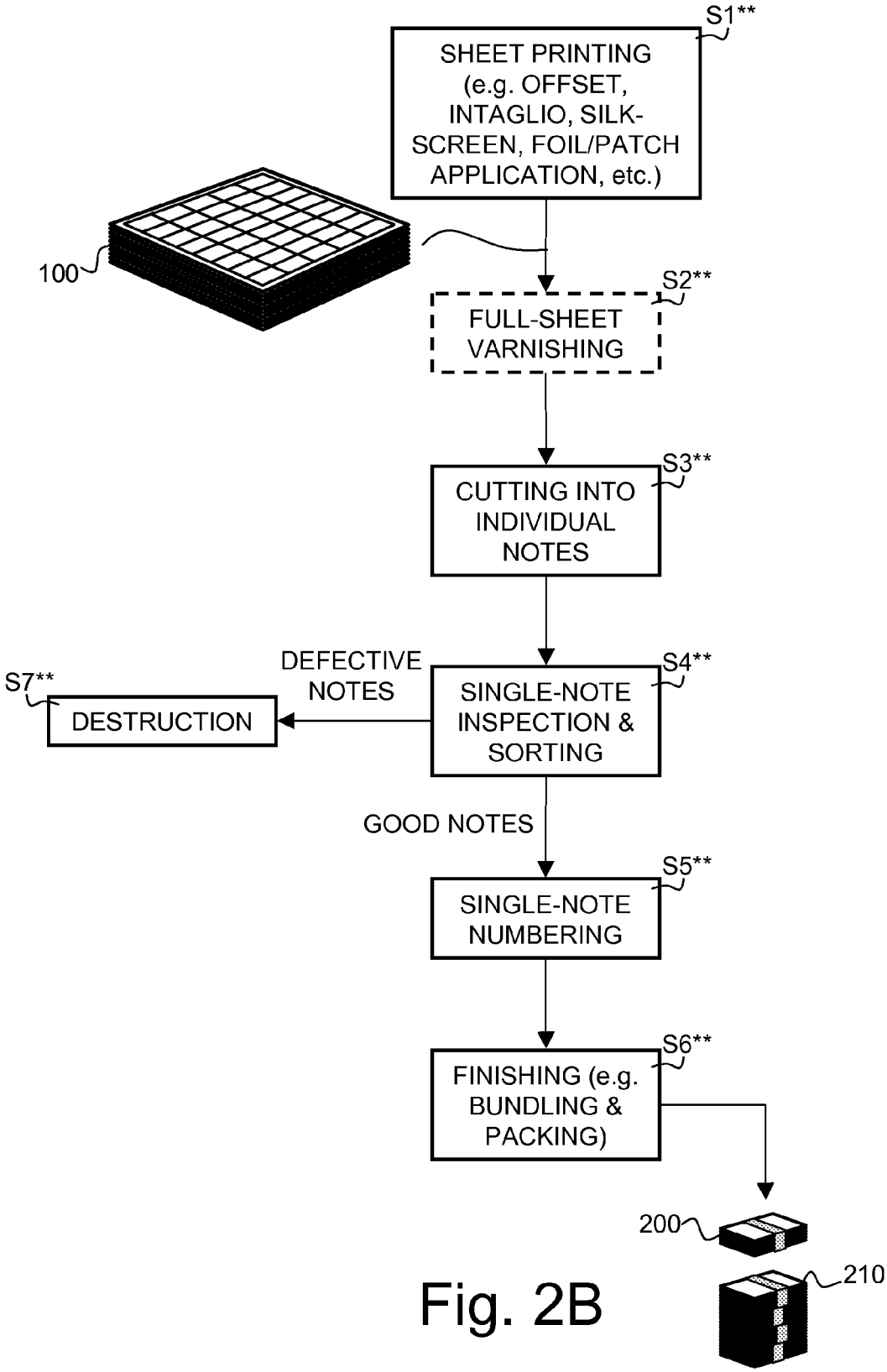
FIG. 2B is a flow chart illustrating a variant of the process of FIG. 2A for producing notes of securities wherein all the production is subjected to single-note processing.

For instance, while the implementation of FIG. 4 was described in the context of the production principle of FIG. 2A, this implementation can easily be modified to operate according to the production principle of FIG. 2B. To this end, the numbering press 305 in FIG. 4 may be discarded and each one of the single-note processing stations SNPS 1 to SNPS may be provided with its own numbering means for numbering the individual notes 150.

In addition, while the above-described embodiments of the invention refer to sheet processing, the invention is equally applicable to the processing of successive portions of a continuous web.

Lastly, in the above-described embodiments, use was made of a single-note processing system comprising four single-note processing stations. It will be understood that a smaller or greater number of single-note processing stations might be used. Preferably, the number of single-note processing stations should be selected as being equal to the following expression (3) where $N_{STATION}$ designates the number of singe-note processing stations, $S_{SHEET}$ designates the sheet processing speed of the sheet-fed processing system, $S_{NOTE}$ designates the note processing speed of each single-note processing station, $N_{NOTE}$ designates the number of notes per sheet, and function ROUNDDOWN(x) designates the function that returns the rounded-down integer of x.

$$N_{STATION}=\text{ROUNDDOWN}(N_{NOTE}\cdot S_{SHEET}/S_{NOTE}) \quad (3)$$

In the above-mentioned numerical examples where $N_{NOTE}=50$, $S_{NOTE}=120'000$ notes per hour, and $S_{SHEET}=10'000$ sheets per hour, $N_{STATION}$ equals 4.

Five single-note processing stations could be used in this example, but this would imply that each station would be fed with a new subset of 50'000 notes every thirty minutes (rather than every twenty-four minutes in the above described example), which in turn implies that each station would operate in a discontinuous manner, each station remaining idle (under normal operation conditions) for a duration of five minutes between the processing of two successive subsets.

The invention claimed is:

1. A method of producing notes of securities, wherein individual printed sheets or successive printed portions of a continuous web are cut into individual notes on a sheet-fed or web-fed processing system, and wherein said individual notes are subsequently processed by a single-note processing system comprising a plurality of single-note processing stations, wherein individual notes corresponding to a plurality of production cycles are produced on said sheet-fed or web-fed processing system, each one of the plurality of production cycle being processed on a corresponding one of said plurality of single-note processing stations, and wherein each production cycle is subdivided into a sequence of distinct production sub-cycles corresponding to successive subsets of individual notes that are to be processed on said single-note processing stations, said subsets of individual notes being produced on said sheet-fed or web-fed processing system according to a time-wise interleaved sequence of production sub-cycles corresponding to distinct production cycles.

2. The method according to claim 1, wherein said subsets of individual notes are buffered in succession at an input of the corresponding single-note processing stations.

3. The method according to claim 1, wherein the number of individual notes per subset is chosen to be a number comprised between 10'000 to 50'000 notes.

4. The method according to claim 1, wherein said production sub-cycles are carried out in dependence of an operating state of said single-note processing stations.

5. The method according to claim 1, wherein each subset of individual notes is temporarily stored in a corresponding container device which container device is transported to the corresponding one of said single-note processing stations and returned to said sheet-fed or web-fed processing system after having been emptied.

6. The method according to claim 1, further comprising automatically guiding and transporting said subsets of notes to and from the single-note processing stations.

7. The method according to claim 1, wherein said individual notes are produced on said sheet-fed or web-fed processing system in the form of consecutively-numbered notes according to selected numbering cycles, and wherein each production cycle corresponds to a determined one of a plurality of independent numbering cycles or to a determined one of a plurality of portions of a same numbering cycle.

8. The method according to claim 7, wherein said subsets of individual notes are buffered in succession at an input of the corresponding single-note processing stations.

9. The method according to claim 7, wherein the number of individual notes per subset is chosen to be a number comprised between 10'000 to 50'000 notes.

10. The method according to claim 7, wherein said production sub-cycles are carried out in dependence of an operating state of said single-note processing stations.

11. The method according to claim 7, wherein each subset of individual notes is temporarily stored in a corresponding container device which container device is transported to the corresponding one of said single-note processing stations and returned to said sheet-fed or web-fed processing system after having been emptied.

12. The method according to claim 7, further comprising automatically guiding and transporting said subsets of notes to and from the single-note processing stations.

13. The method according to claim 1, wherein said individual notes are numbered in said single-note processing stations.

14. The method according to claim 1, wherein the notes of securities are banknotes.

15. A system for producing notes of securities, comprising a sheet-fed or web-fed processing system for cutting individual printed sheets or successive printed portions of a continuous web into individual notes, and a single-note processing system for processing said individual notes produced by the sheet-fed or web-fed processing system, said single-note processing system including a plurality of single-note processing stations, wherein said sheet-fed or web-fed processing system is designed to produce individual notes corresponding to a plurality of production cycles, each one of the plurality of production cycles being processed on a corresponding one of said plurality of single-note processing stations, each production cycle being subdivided into a sequence of distinct production sub-cycles corresponding to successive subsets of individual notes that are to be processed on said single-note processing stations, and wherein said sheet-fed or web-fed processing system is further designed to output said subsets of individual notes according to a time-wise interleaved sequence of production sub-cycles corresponding to distinct production cycles.

16. The system according to claim 15, wherein each of said single-note processing stations includes an input buffering stage for buffering the subsets of individual notes.

17. The system according to claim 15, wherein the number of individual notes per subset is chosen to be a number comprised between 10'000 to 50'000 notes.

18. The system according to claim 15, wherein said sheet-fed or web-fed processing system is further designed to produce said subsets of individual notes in dependence of an operating state of said single-note processing stations.

19. The system according to claim 15, further comprising a plurality of container devices for temporarily storing said subsets of individual notes produced by the sheet-fed or web-fed processing system, which container devices are designed to be transported to a corresponding one of said single-note processing stations and be returned to said sheet-fed or web-fed processing system after having been emptied.

20. The system according to claim 15, further comprising an automated guide vehicle system for transporting said subsets of notes between the sheet-fed or web-fed processing system and the single-note processing stations.

21. The system according to claim 15, wherein said sheet-fed or web-fed processing system comprises a sheet-fed or web-fed numbering press for performing selected numbering cycles, and wherein each production cycle of the sheet-fed or web-fed processing system corresponds to a determined one of a plurality of independent numbering cycles or to a determined one of a plurality of portions of a same numbering cycle.

22. The system according to claim 21, wherein each of said single-note processing stations includes an input buffering stage for buffering the subsets of individual notes.

23. The system according to claim 21, wherein the number of individual notes per subset is chosen to be a number comprised between 10'000 to 50'000 notes.

24. The system according to claim 21, wherein said sheet-fed or web-fed processing system is further designed to produce said subsets of individual notes in dependence of an operating state of said single-note processing stations.

25. The system according to claim 21, further comprising a plurality of container devices for temporarily storing said subsets of individual notes produced by the sheet-fed or web-fed processing system, which container devices are designed to be transported to a corresponding one of said single-note processing stations and be returned to said sheet-fed or web-fed processing system after having been emptied.

26. The system according to claim 21, further comprising an automated guide vehicle system for transporting said subsets of notes between the sheet-fed or web-fed processing system and the single-note processing stations.

27. The system according to claim 15, wherein each one of said single-note processing stations is provided with its own numbering means for numbering said individual notes.

* * * * *

UNITED STATES PATENT AND TRADEMARK OFFICE

CERTIFICATE OF CORRECTION

PATENT NO. : 8,387,496 B2
APPLICATION NO. : 12/593706
DATED : March 5, 2013
INVENTOR(S) : Johannes Georg Schaede It is certified that error appears in the above-identified patent and that said Letters Patent is hereby corrected as shown below:

Title Page, Item (57) ABSTRACT

Line 14: delete "(150)".

Line 17: delete "(300)".

In the Specifications:

Column 3, Line 30: delete "52, 53, 54" and insert -- S2, S3, S4 --.

Column 4, Line 20: delete "56" and insert -- S6 --.

Column 5, Line 39: delete "processed b station" and insert -- processed by station --.

Signed and Sealed this
Twenty-third Day of July, 2013

Teresa Stanek Rea
*Acting Director of the United States Patent and Trademark Office*